US006918973B2

(12) United States Patent
Hufnagel et al.

(10) Patent No.: US 6,918,973 B2
(45) Date of Patent: Jul. 19, 2005

(54) ALLOY AND METHOD OF PRODUCING THE SAME

(75) Inventors: Todd C. Hufnagel, Lutherville, MD (US); Ryan T. Ott, Baltimore, MD (US); Cang Fan, Baltimore, MD (US); Laszlo Kecskes, Havre de Grace, MD (US)

(73) Assignees: Johns Hopkins University, Baltimore, MD (US); United States Army Research Laboratory, Aberdeen Proving Ground, MD (US)

( * ) Notice: Subject to any disclaimer, the term of this patent is extended or adjusted under 35 U.S.C. 154(b) by 119 days.

(21) Appl. No.: 10/287,627

(22) Filed: Nov. 5, 2002

(65) Prior Publication Data

US 2005/0121117 A1 Jun. 9, 2005

Related U.S. Application Data

(60) Provisional application No. 60/330,947, filed on Nov. 5, 2001.

(51) Int. Cl.[7] ..... C22C 45/00
(52) U.S. Cl. ..... 148/538; 148/561
(58) Field of Search ..... 148/403, 538, 148/561

(56) References Cited

U.S. PATENT DOCUMENTS

| | | | | |
|---|---|---|---|---|
| 4,144,058 A | | 3/1979 | Chen et al. | |
| 4,494,461 A | * | 1/1985 | Pryor et al. | 102/464 |
| 4,642,139 A | | 2/1987 | Taub et al. | |
| RE32,925 E | | 5/1989 | Chen et al. | |
| 4,915,903 A | * | 4/1990 | Brupbacher et al. | 420/129 |
| 4,915,908 A | * | 4/1990 | Nagle et al. | 420/590 |
| 5,080,727 A | * | 1/1992 | Aihara et al. | 148/648 |

(Continued)

FOREIGN PATENT DOCUMENTS

| | | |
|---|---|---|
| EP | 0905268 | 3/1999 |
| EP | 0905269 | 3/1999 |
| JP | 11-189855 | 7/1999 |
| JP | 2000-129378 | 5/2000 |
| JP | 2000-265252 | 9/2000 |
| WO | WO/00/26425 | 5/2000 |
| WO | WO 00/68469 | 11/2000 |

OTHER PUBLICATIONS

Fan, C. and Inoue, A.; "Ductility of bulk nanocrystalline composites and metallic glasses at room temperature", *Applied Physics Letters*, vol. 77, No. 1, pp. 46–48, Jul. 3, 2000.

(Continued)

*Primary Examiner*—George Wyszomierski
(74) *Attorney, Agent, or Firm*—Dickstein Shapiro Morin & Oshinsky LLP

(57) ABSTRACT

In accordance with a preferred embodiment of the invention, an alloy or other composite material is provided formed of a bulk metallic glass matrix with a microstructure of crystalline metal particles. The alloy preferably has a composition of $(X_aNi_bCu_c)_{100-d-c}Y_dAl_c$, wherein the sum of a, b and c equals 100, wherein $40 \leqq a \leqq 80$, $0 \leqq b \leqq 35$, $0 \leqq c \leqq 40$, $4 \leqq d \leqq 30$, and $0 \leqq e \leqq 20$, and wherein preferably X is composed of an early transition metal and preferably Y is composed of a refractory body-centered cubic early transition metal. A preferred embodiment of the invention also provides a method of producing an alloy composed of two or more phases at ambient temperature. The method includes the steps of providing a metastable crystalline phase composed of at least two elements, heating the metastable crystalline phase together with at least one additional element to form a liquid, casting the liquid, and cooling the liquid to form the alloy. In accordance with a preferred embodiment of the invention, the composition and cooling rate of the liquid can be controlled to determine the volume fraction of the crystalline phase and determine the size of the crystalline particles, respectively.

18 Claims, 5 Drawing Sheets

U.S. PATENT DOCUMENTS

| | | | | |
|---|---|---|---|---|
| 5,288,344 | A | 2/1994 | Peker et al. | |
| 5,711,363 | A | 1/1998 | Scruggs et al. | |
| 5,735,975 | A | 4/1998 | Lin et al. | |
| 5,740,854 | A | 4/1998 | Inoue et al. | |
| 5,908,513 | A * | 6/1999 | Sasaki et al. | 148/302 |
| 6,231,697 | B1 | 5/2001 | Inoue et al. | |
| 6,258,185 | B1 | 7/2001 | Branagan et al. | |
| 6,267,171 | B1 | 7/2001 | Onuki et al. | |
| 6,427,753 | B1 | 8/2002 | Inoue et al. | |
| 6,764,560 | B1 * | 7/2004 | Mogilevsky | 148/543 |

OTHER PUBLICATIONS

Fan, C.; Li, C.; Inoue, A.; Haas, V.; "Deformation behavior of Zr–based bulk nanocrystalline amorphous alloys", *Physical Review B* (*Condensed Matter*), vol. 61, No. 6, p. R3761–3, Feb. 1, 2000.

Saida, J.; Inoue, A.; "Icosahedral quasicrystalline phase formation in Zr–Al–Ni–Cu glassy alloys by addition of Nb, Ta and V elements", *Journal of Physics: Condensed Matter*, vol. 13, No. 4, p. L73–8, Jan. 29, 2001.

Kuhn, U., et al., "ZrNbCuNiAl bulk metallic glass matrix composites containing dendritic bcc phase precipitates", Applied Physics Letters, vol. 80, No. 14, Apr. 8, 2002.

Hays, C.C., et al., "Microstructure Controlled Shear Band Pattern Formation and Enhanced Plasticity of Bulk Metallic Glasses Containing in situ Formed Ductile Phase Dendrite Dispersons", Physical Review Letters, vol. 84, No. 13, Mar. 28, 2000.

* cited by examiner

ALLOY AND METHOD OF PRODUCING THE SAME

This application claims priority to U.S. provisional application 60/330,947, filed Nov. 5, 2001, which is incorporated herein in its entirety.

GOVERNMENT INTEREST

The invention was made with government support under Grant No. DE-FG02-98ER45699 awarded by the Department of Energy and Grant No. DAAD-19-01-2-0003 awarded by the U.S. Army Research Laboratory. The government has certain rights in the invention.

BACKGROUND

Bulk metallic glasses ("BMG") have generated interest as structural materials due to their unique mechanical properties, which include high strength and large elastic elongation. Metallic glasses, unlike conventional crystalline alloys, have an amorphous or disordered atomic-scale structure that gives them unique properties. For instance, metallic glasses have a glass transition temperature ($T_g$) above which they soften and flow. This characteristic allows for considerable processing flexibility. Known metallic glasses have only been produced in thin ribbons, sheets, wires, or powders due to the need for rapid cooling from the liquid state to avoid crystallization. A recent development of bulk glass-forming alloys, however, has obviated, this requirement, allowing for the production of metallic glass ingots greater than one centimeter in thickness. This development has permitted the use of metallic glasses in engineering applications where their unique mechanical properties, including high strength and large elastic elongation, are advantageous.

A common limitation of conventional metallic glasses, however, is their tendency to experience plastic deformation in narrow regions called shear bands. This localized deformation increases the likelihood that metallic glasses will fail in an apparently brittle manner in any loading condition (such as tension) where the shear bands are unconstrained. As a result, monolithic metallic glasses typically display limited plastic flow (0–4% under uniaxial compression) at ambient or room temperature. This lack of widespread plastic deformation results in low toughness. Toughness is a critical parameter in any structural material.

SUMMARY

In accordance with a preferred embodiment of the invention, an alloy or other composite material is provided formed of a bulk metallic glass matrix with a microstructure of crystalline metal particles. The alloy preferably has a composition of $(X_aNi_bCu_c)_{100-d-c}Y_dAl_c$, wherein the sum of a, b and c equals 100, wherein $40 \leqq a \leqq 80$, $0 \leqq b \leqq 35$, $0 \leqq c \leqq 40$, $4 \leqq d \leqq 30$, and $0 \leqq e \leqq 20$, and wherein preferably X is composed of an early transition metal and preferably Y is composed of a refractory body-centered cubic early transition metal.

A preferred embodiment of the invention also provides a method of producing an alloy composed of two or more phases at ambient temperature. The method includes the steps of providing a metastable crystalline phase composed of at least two elements, heating the metastable crystalline phase together with at least one additional element to form a liquid, casting the liquid, and cooling the liquid Lo form the alloy. In accordance with a preferred embodiment of the invention, the composition and cooling rate of the liquid can be controlled to determine the volume fraction of the crystalline phase and determine the size of the crystalline particles, respectively.

These and other advantages and features of the invention will be more readily understood from the following detailed description of the invention that is provided in connection with the accompanying drawings.

DETAILED DESCRIPTION OF PREFERRED EMBODIMENTS

Figure 1:
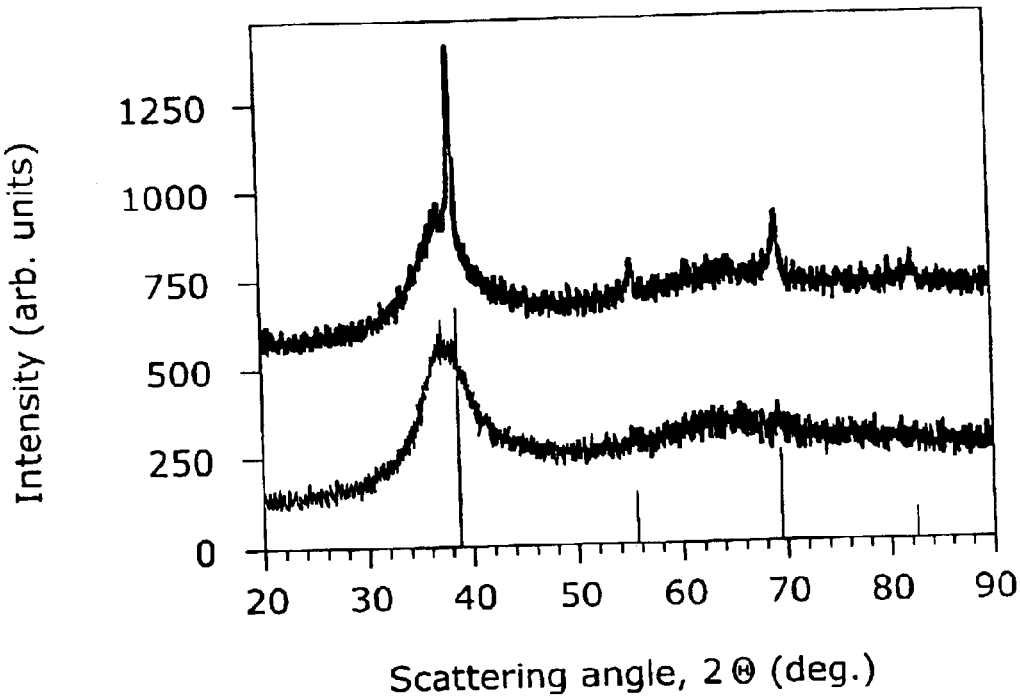
FIG. 1 is a graph indicating x-ray diffraction patterns for alloys constructed from composites in accordance with an embodiment of the invention.

In accordance with a preferred embodiment of the invention, a new type of bulk metallic glass ("BMG") matrix composite alloy has been prepared using an in situ processing method. Preferably, this BMG matrix composite alloy is a two-phase alloy including a metallic glass matrix and a microstructure having crystalline particles embedded in the metallic glass matrix. The volume fraction of the crystalline particles may be controlled through control of the composition of the BMG matrix composite alloy. Alternatively, the size of the crystalline particles may be controlled through control of the cooling rate or by heat treating the precursor materials.

In a preferred embodiment, the BMG matrix composite alloy has a general composition (in atomic percentage) of $((X)_aNi_bCu_c)_{100-d-c}Y_dAl_c$. In this general composition, a+b+c equals 100, where $40 \leqq a \leqq 80$, $0 \leqq b \leqq 35$, $0 \leqq c \leqq 40$, $4 \leqq d \leqq 30$, and $0 \leqq e \leqq 20$, where X is composed of an early transition metal and Y is composed of a refractory body-centered cubic early transition metal. Preferably, $40 \leqq a \leqq 65$, $0 \leqq b \leqq 10$, $0 \leqq c \leqq 20$, $4 \leqq d \leqq 30$, and $0 \leqq e \leqq 15$. X may, for example, be Zirconium (Zr), Hafnium (Hf), or Titanium (Ti), any of which may be substituted for each other in any proportion. Y, for example, may be tantalum (Ta), which may be replaced by another refractory body-centered cubic (bcc) early transition metal such as vanadium (V), niobium (Nb), molybdenum (Mo), tungsten (W), etc. Any variety of materials or compositions may be used. The crystalline particles may be, for example, formed by tantalum alone or a combination of tantalum and zirconium. Further, in a preferred embodiment, die crystalline particles may be a crystalline solid solution having a composition of greater than eighty percent tantalum. The average grain size of the crystalline particles is preferably between about 0.1 microns and about 100 microns, and preferably, between about 10 microns and about 50 microns.

In accordance with a preferred embodiment, a homogeneous melt from one of these alloys is cast in such a way as to cool the melt at a moderately high cooling rate, preferably less than 1000 K/s. As a result, a microstructure is produced including a bulk metallic glass matrix surrounding homogeneously dispersed, micron-scale equiaxial crystalline particles rich in a refractory body-centered cubic (bcc) metal, such as tantalum (Ta), vanadium (V), niobium (Nb), molybdenum (Mo), or tungsten (W). In accordance with a preferred embodiment, the volume fraction of the particles can be controlled by varying the composition of the alloy (e.g., increasing with increasing d), and their size and spacing can be controlled by varying the cooling rate (e.g., decreasing with increasing cooling rate). The matrix may be a metallic glass, and it may be partially or fully crystalline or partially or fully quasi-crystalline.

The BMG matrix composite alloy of a preferred embodiment of the invention exhibits, under loading, a significant increase in the plasticity experienced by the sample in quasi-static uniaxial compression than conventional metallic glasses. Additionally, the BMG matrix composite alloy retains the characteristic properties of a metallic glass such as a glass transition temperature, a high yield strength (e.g., about two GPa), and a large elastic elongation (e.g., about two percent). Like monolithic metallic glasses, at room temperature the BMG matrix composite alloy deforms by localized plastic deformation in shear bands. Unlike monolithic metallic glasses, however, the presence of the second-phase particles (Ta, V, Nb, Mo, W, etc.) promotes the formation of new shear bands in the BMG matrix composite alloy, while also inhibiting the propagation of existing shear bands. The result is a distribution of plastic strain, forming a composite with significantly enhanced ductility. Preferably, the plastic strain to failure in uniaxial compression at ambient temperature is greater than five percent and up to 15 percent, and the plastic strain to failure in uniaxial tension at ambient temperature is greater than two percent.

In accordance with a preferred embodiment of the invention, a BMG matrix composite alloy can be made by a low cost in situ method directly from the melt. The BMG matrix composite alloy can be produced by vacuum arc melting an ingot of the desired composition, followed by casting into a copper mold, or by any similar technique (such as die casting) that provides sufficiently rapid cooling of the melt. The crystalline particles may be obtained through a variety of methods, such as, for example, precipitating them from a supersaturated solid solution prior to melting and solidification of the composite alloy, precipitating them from a liquid alloy during cooling, precipitating them from a supercooled liquid alloy during cooling, or precipitating them from a solid alloy by annealing.

EXAMPLES

To illustrate implementations of one or more embodiments of the invention, the following examples are provided. An exemplary method of preparing BMG matrix composite alloys was implemented in accordance with an embodiment of the invention. The materials used in preparing the alloys were metals of high purity: copper (99.999%), aluminum (99.999%), tantalum (99.995%), niobium (99.995%), and a zirconium crystal bar with <300 parts per million (ppm) oxygen content. Alloys of the composition $(Zr_{70}Ni_{10}Cu_{20})_{90-d}Ta_dAl_{10}$ were prepared, where d equaled 2, 4, 5, 6, 8, 10 or 12.

The different alloys were prepared by arc melting in a titanium-gettered argon atmosphere on a water cooled copper hearth. The different alloys were prepared through a two-step process: (1) the zirconium and tantalum were combined to create a metastable crystalline phase and melted together to produce a homogeneous master alloy ingot; and (2) the nickel, aluminum, and copper were then melted with the zirconium-tantalum master alloy ingot. The nickel, aluminum, and copper may first be combined together prior to their combination with the metastable crystalline phase. The heat used to melt the elements into the BMG matrix composite alloy may include electric arc heating or induction heating. For each step, the ingot was melted and flipped four or five times to promote homogeneity.

The final ingot was then cast into a copper mold to produce rods three millimeters in diameter and five centimeters in length. The casting may be accomplished through permanent mold casting, suction casting, injection die casting, pour casting, planar flow casting, melt spinning, or extrusion.

The metastable crystalline phase may be annealed, to precipitate particles, prior to combination with the other elements. Doing so may control: (1) the size of the precipitated particles; (2) the volume fraction of the precipitated particles; and/or, (3) the shape of the precipitated particles. Alternatively, the metastable crystalline phase may be a solid solution supersaturated in one or more elements at either ambient or an elevated temperature. Instead, the metastable crystalline phase may include a crystalline microstructure formed at an elevated temperature and retained at ambient temperature by rapid cooling. The crystalline particles may be stable in contact with the liquid alloy prior to casting. It should be appreciated that the crystalline particles have a melting temperature significantly higher than that of the remainder of the BMG matrix composite alloy. After casting, the alloy can be additionally shaped by molding or pressing at a temperature above, at or just below the glass transition temperature of the BMG matrix composite alloy.

The phases present in the as-cast samples were examined with X-ray diffraction (XRD) using a Rigaku TTRAXS $\theta/\theta$ rotating anode diffractometer with Cu $K\alpha$ radiation ($\lambda$=0.154 nm). The microstructure was examined using a Phillips CM300 field emission transmission electron microscope (TEM) and a JEOL 8600 Microprobe. The thermal properties of the composite samples were measured in a Perkin-Elmer Pyris 1 differential scanning calorimeter (DSC). Quasi-static compression tests were performed using a MTS servohydraulic machine.

The diffraction patterns for $(Zr_{70}Ni_{10}Cu_{20})_{90-d}Ta_dAl_{10}$ (where d=6 and 12) are shown in FIG. 1. The diffraction patterns indicate a broad scattering feature at 38° 2θ along with sharp Bragg peaks corresponding to a crystalline phase. The broad scattering feature is consistent with an amorphous phase, in this case the matrix of the composite. The sharp Bragg peaks are identified as body-centered cubic tantalum. No other crystalline peaks can be seen in the diffraction patterns. Additionally, it can be seen that the scattering intensity of the tantalum peaks increases with an increasing atomic percentage of tantalum in the alloy. This indicates that the volume fraction of crystalline tantalum in the two-phase microstructure increases with increasing tantalum concentration.

Figure 2:
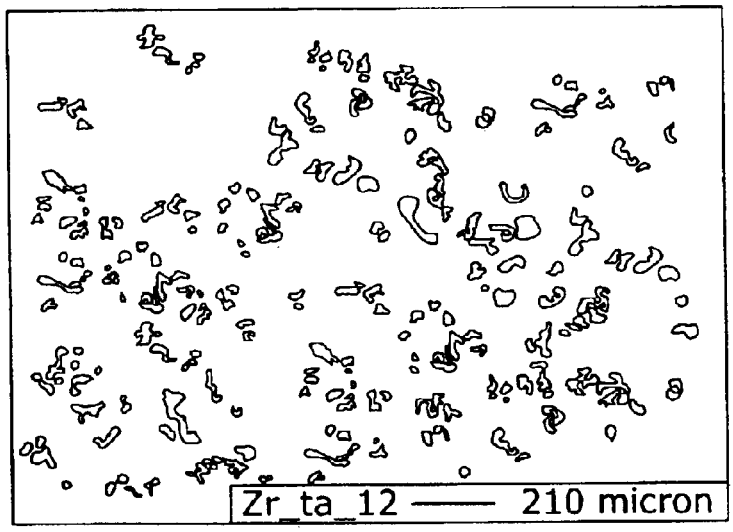
FIG. 2 is an optical micrograph of an alloy constructed in accordance with an embodiment of the invention.
Figure 3:
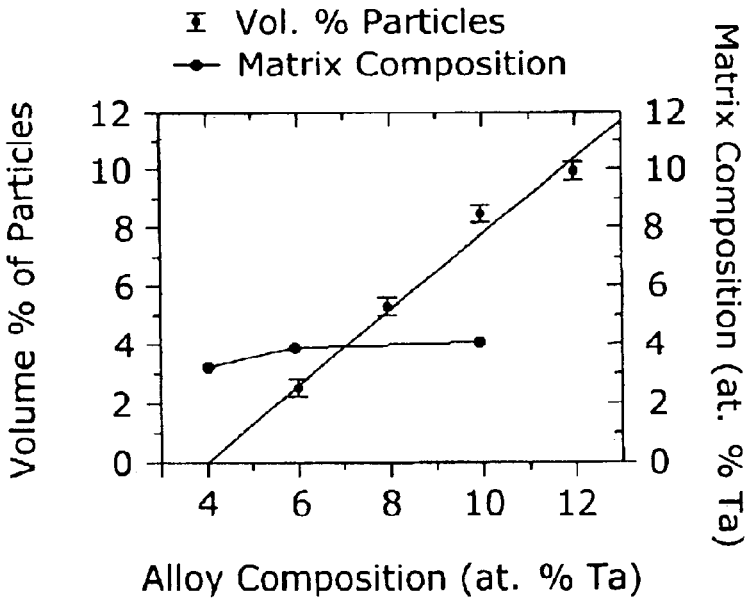
FIG. 3 is a graph plotting the fraction of the crystalline phase and the tantalum concentration in an amorphous matrix as a function of the overall tantalum content in an alloy constructed in accordance with an embodiment of the invention.

The as-cast composite microstructure for a ten percent tantalum alloy is shown in the optical micrograph in FIG. 2. The microstructure consists of homogeneously dispersed particles (dark phase) in an amorphous matrix (light phase). The particles are oblong in shape but do not appear to possess a dendritic structure. The average size of the particles is approximately 30–40 $\mu$m. An electron microprobe determined the average chemical composition of the crystalline particles to be $Ta_{93.2}Zr_{5.4}(Cu+Ni+Al)_{1.4}$ (all compositions are in atomic percent). Optical micrographs for as-cast samples containing 4, 6, 8, 10, and 12 atomic percent of tantalum were examined. For the alloy containing 4% tantalum, there are no detectable precipitates in the optical micrographs. This would indicate that the tantalum solubility in the amorphous matrix is approximately 4%. The solubility of tantalum in the matrix was further examined by measuring the chemical composition of the matrix for the 4, 6, and 10 atomic percentage of tantalum alloys with an electron microprobe. FIG. 3 shows the results of the matrix composition measurements along with the tantalum particle volume fraction measurements. It can be seen in FIG. 3 that the volume fraction of the tantalum-rich particles present in the amorphous matrix scales linearly with the tantalum content in the alloy. This indicates that the microstructure can be tailored readily through variations in the alloy composition. Additionally, the microprobe results indicate that the amorphous matrix contains slightly less than 4% tantalum as predicted based on the volume fraction measurements.

Figure 4:
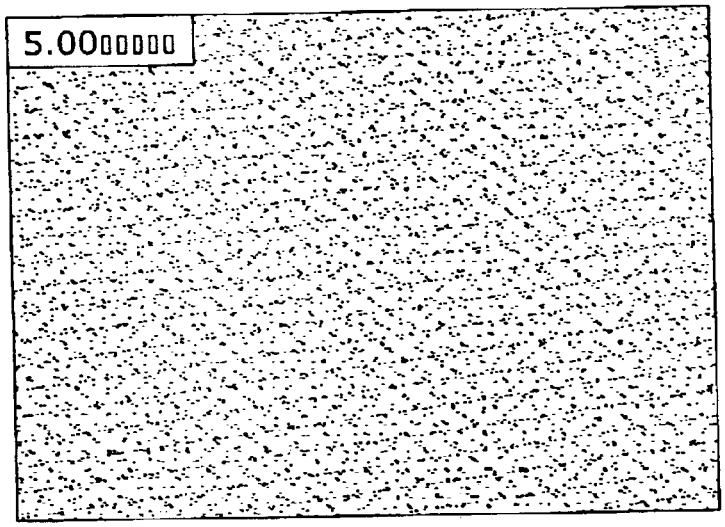
FIG. 4 is a high resolution transmission electron microscope image of the amorphous matrix of FIG. 3.

To further confirm that the microstructure consists of crystalline tantalum-rich particles in an amorphous matrix, the matrix phase was examined using high-resolution transmission electron microscopy (HRTEM). The HRTEM image of the matrix shown in FIG. 4 shows no evidence of lattice fringes, which would be associated with a crystalline structure. This is consistent with the X-ray diffraction patterns, which show no evidence of long-range order other than the crystalline tantalum-rich particles. Thus, the matrix surrounding the particles is amorphous.

Figure 5:
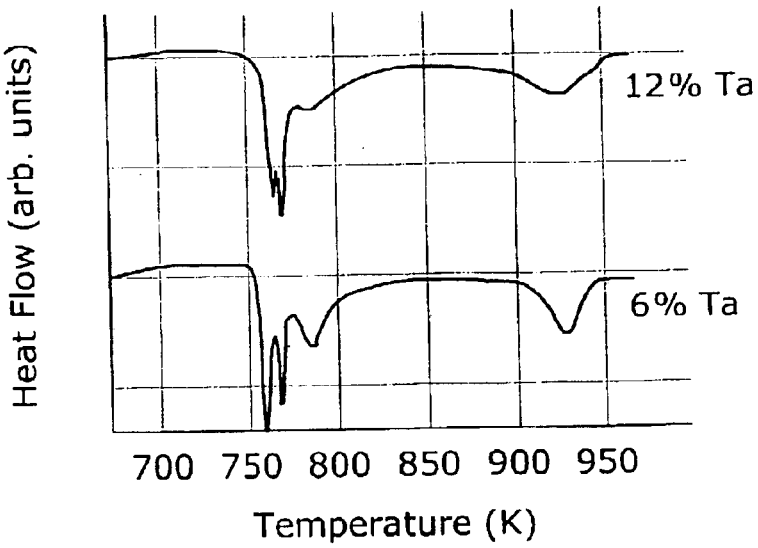
FIG. 5 is a graph indicating thermal properties of alloys constructed from composites in accordance with an embodiment of the invention.
Figure 6:
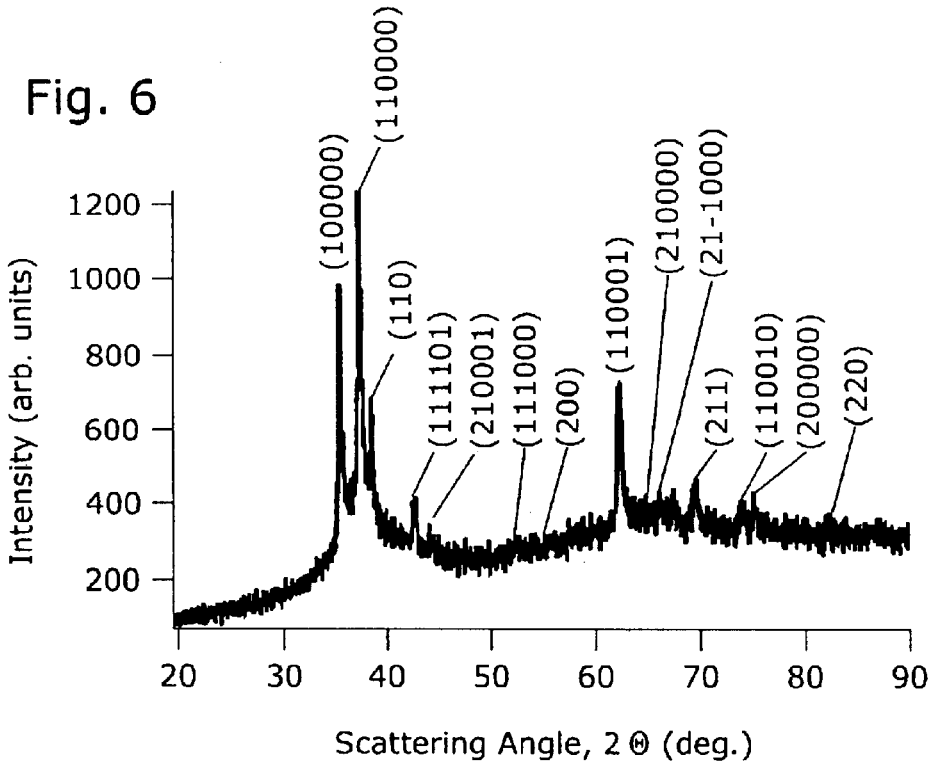
FIG. 6 is a graph indicating an x-ray diffraction pattern for an annealed alloy constructed from a composite in accordance with an embodiment of the invention.
Figure 7:
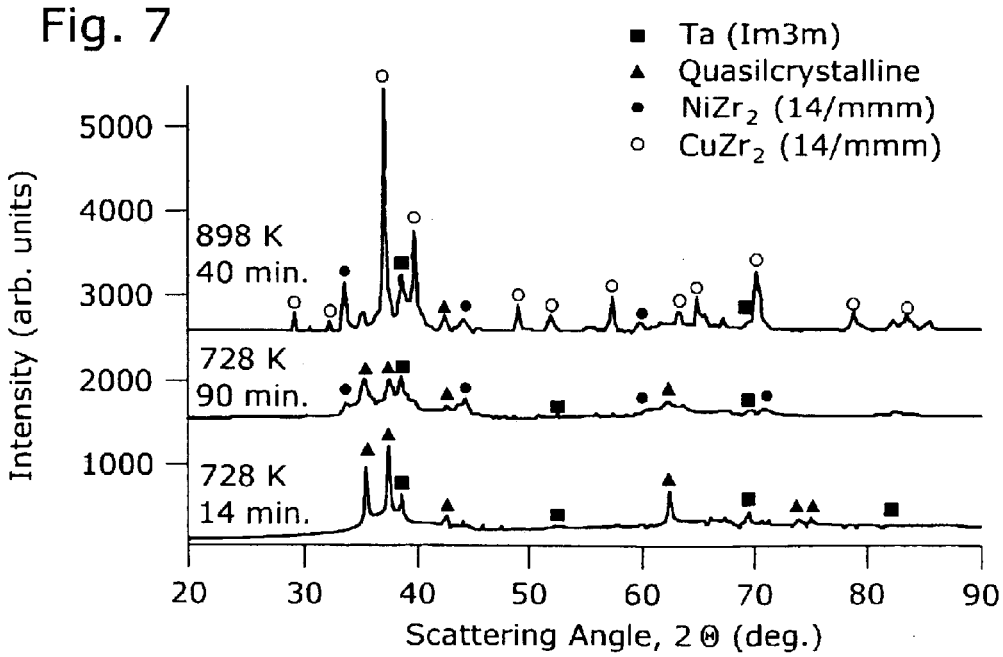
FIG. 7 is a graph indicating x-ray diffraction patterns for annealed alloys constructed from composites in accordance with an embodiment of the invention.

The thermal properties of the amorphous matrix were examined using differential scanning calorimeter (DSC) analysis. The constant rate DSC scans for the 6 and 12% tantalum alloys are shown in FIG. 5. To determine the crystallization sequence for the alloys, isothermal DSC was performed and the resulting microstructures were examined with X-ray diffraction. The XRD pattern for the 6% tantalum alloy, which had been annealed through the first exothermic peak, is shown in FIG. 6. The annealed sample shows the crystalline tantalum peaks with additional sharp Bragg peaks corresponding to another crystalline phase. Using Bancel's indexing method, the peaks were found to be consistent with the formation of icosohedral quasicrystals (I phase). Further annealing of the sample resulted in the transformation of the icosohedral phase into the $NiZr_2$ crystalline phase, which indicates that the quasicrystals are metastable. FIG. 7 shows the XRD patterns for the annealed samples. When the samples were annealed through the last exothermic peak, the diffraction peaks associated with the quasicrystals disappeared and the intensity of the $NiZr_2$ peaks were greatly reduced in intensity while the predominant phase present in the microstructure appeared to be the newly nucleated $CuZr_2$ phase. Therefore, at higher temperatures, the $CuZr_2$ phase appears to be the most stable and crystallization sequence can be represented as follows:

$$\text{Amorphous} \rightarrow \text{Amorphous+I phase} \rightarrow \text{I phase+NiZr}_2 \rightarrow \text{NiZr}_2\text{+CuZr}_2.$$

Figure 8:
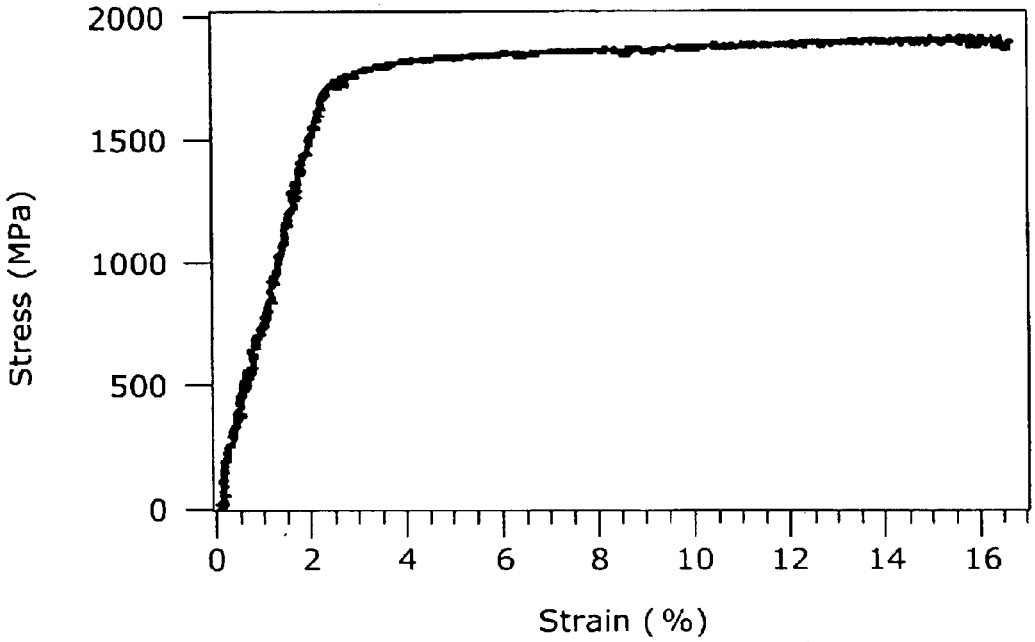
FIG. 8 is a graph indicating mechanical properties for an alloy constructed from a composite in accordance with an embodiment of the invention.

The mechanical properties of the alloy series were examined via quasi-static compression testing. Following ASTM standards, the samples tested had a length-to-diameter ratio of two to one. FIG. 8 shows the compressive stress-strain curve for the as cast 8% tantalum alloy under quasi-static loading (strain rate~$10^{-4}s^{-1}$). The specimen exhibited an exceptionally large enhancement in the plastic strain prior to failure relative to monolithic metallic glasses of similar composition, which typically show 1–2 percent plastic strain before failure. The composite alloys tested here showed up to 15 percent total plastic strain prior to failure. The compressive tests also show that the large elastic elongation and high yield strength associated with the amorphous phase were largely unchanged.

In accordance with a preferred embodiment of the invention, the alloy possesses the proper characteristics and physical attributes to make it desirable for various civilian and military applications, such as in the aerospace, transportation and sporting goods industries (e.g., golf club heads). For example, the high strength, good compressive ductility and potentially good fracture toughness make use the composite material promising as a kinetic energy penetrator in armor-piercing projectiles. Other potential applications for the novel alloy include springs and other compliant mechanisms.

While preferred embodiments of the invention have been described in detail herein, it should be readily understood that the invention is not limited to such disclosed embodiments. Rather, disclosed embodiments can be modified to incorporate any number of variations, alterations, substitutions or equivalent arrangements not heretofore described, but which are commensurate with the spirit and scope of the invention. Accordingly, the invention is not to be seen as limited by the foregoing description, but is only limited by the scope of the appended claims.

What is claimed as new and desired to be protected by Letters Patent of the United States is:

1. A method of producing an amorphous alloy comprising two or more phases at ambient temperature, comprising the steps of:

providing a metastable crystalline alloy comprising at least two elements;

heating the metastable crystalline alloy together with at least one additional element to form a liquid with suspended particles of a crystalline phase;

casting the liquid; and cooling the liquid to form the amorphous alloy;

wherein said providing includes controlling composition of the liquid.

2. The method of claim 1, wherein the controlling of the composition of the liquid determines a volume fraction of the metastable crystalline alloy.

3. The method of claim 1, wherein said heating comprises heating the metastable crystalline alloy together with at least two additional elements, the additional elements being combined with each other prior to the heating step.

4. The method of claim 1, further comprising annealing the metastable crystalline alloy prior to said heating step.

5. The method of claim 1, wherein said heating comprises electric arc heating.

6. The method of claim 1, wherein said heating comprises induction heating.

7. The method of claim 1, wherein said casting comprises one of the group consisting of permanent mold casting, suction casting, injection die casting, pour casting, planar flow casting, melt spinning, and extrusion.

8. The method of claim 1, further comprising shaping the alloy at a temperature above, at or just below the glass transition temperature of the solid alloy.

9. The method of claim 1, wherein the alloy has a composition of $((Zr, Hf)_a Ni_b CU_c)_{100-d-c} Ta_d Al_c$, where a+b+c equals 100, $40 \leqq a \leqq 65$, $0 \leqq b \leqq 10$, $0 \leqq c \leqq 20$, $4 \leqq d \leqq 30$, and $0 \leqq e \leqq 15$.

10. The method of claim 1, wherein the alloy produced is a metallic alloy comprising two or more phases at ambient temperature, wherein at least one phase is amorphous and at least one phase is crystalline.

11. The method of claim 1, wherein said providing a metastable crystalline alloy comprises providing a metastable solid solution of at least two elements.

12. The method of claim 11, further comprising annealing the metastable solid solution prior to said heating step to produce a microstructure comprising at least two phases, wherein at least one of the microstructure phases comprises suspended particles in the liquid.

13. The method of claim 1, wherein said cooling further comprises cooling the liquid with the suspended particles to form an alloy with a microstructure comprising at least one crystalline phase embedded in an amorphous matrix.

14. A method of producing an amorphous alloy comprising two or more phases at ambient temperature, comprising the steps of:

providing a metastable crystalline alloy comprising at least two elements;

forming a liquid with suspended particles of the crystalline alloy by heating the metastable crystalline alloy together with at least one additional element;

casting the liquid; and cooling the liquid alloy at a cooling rate to form the amorphous alloy; wherein the cooling rate is controlled.

15. The method of claim 14, wherein the average size of the crystalline particles in the metastable crystalline posse alloy are between about 10 microns and about 50 microns.

16. The method of claim 14, further comprising the step of controlling composition of the liquid.

17. The method of claim 14, further comprising annealing the metastable crystalline alloy.

18. The method of claim 14, wherein the average size of the suspended crystalline particles in the liquid is between about 0.1 microns and about 50 microns.

* * * * *